US005077965A

United States Patent [19]

Jedamzik

[11] Patent Number: 5,077,965

[45] Date of Patent: Jan. 7, 1992

[54] CONVEYOR CHAIN FOR TEXTILE PROCESSING MACHINES

[75] Inventor: Karl-Heinz Jedamzik, Wuppertal, Fed. Rep. of Germany

[73] Assignee: Kolb GmbH & Co., Wuppertal, Fed. Rep. of Germany

[21] Appl. No.: 512,705

[22] Filed: Apr. 23, 1990

[30] Foreign Application Priority Data

Apr. 27, 1989 [DE] Fed. Rep. of Germany ..... 3913933

[51] Int. Cl.[5] ..... F16G 13/12

[52] U.S. Cl. ..... 59/78; 474/91; 474/209; 198/850; 26/89

[58] Field of Search ..... 26/89; 474/91, 209, 474/231; 198/850, 851; 59/4, 5, 78, 84

[56] References Cited

U.S. PATENT DOCUMENTS

| | | | |
|---|---|---|---|
| 2,049,841 | 8/1936 | Kjaer | 474/231 |
| 2,241,820 | 5/1941 | Kohn | 474/209 |
| 3,473,644 | 10/1969 | Hagerborg | 474/231 |
| 3,688,557 | 9/1972 | Marinus | 26/89 |
| 4,620,844 | 11/1986 | Greene et al. | 474/209 |

FOREIGN PATENT DOCUMENTS

| | | | |
|---|---|---|---|
| 589652 | 12/1959 | Canada | 59/4 |
| 1022060 | 1/1958 | Fed. Rep. of Germany | 474/91 |
| 1707286 | 9/1965 | Fed. Rep. of Germany . | |
| 8701147 | 2/1987 | World Int. Prop. O. | 26/89 |

*Primary Examiner*—David Jones

*Attorney, Agent, or Firm*—Robert P. Seitter; J. Gordon Lewis

[57] ABSTRACT

The present invention provides a conveyor chain for textile processing machines in which a lubricant supply is safeguarded at all times in the event of maximum mechanical stressing. The conveyor chain is connected to a center clip body 1 by a pin 2, the pin 2 being surrounded by a link bushing 11 which has a transverse bore 27 for the lubricant supply of an antifriction bearing 10 surrounding the link bushing by lubricant ducts 23, 25 being defined within the pin 2; and at least one side bar 13 is supported on the link bushing 11. The link bushing 11 is coupled to the side bar 13 in a manner to preclude rotation of the link bushing. Between a roller element 20 and the link bushing 11, an internal ring 19 is provided and staggered axially relative to the transverse bore 27, and the antifriction bearing is bounded in an axial direction by at least one cover plate 15.

14 Claims, 2 Drawing Sheets

CONVEYOR CHAIN FOR TEXTILE PROCESSING MACHINES

BACKGROUND OF THE INVENTION

1. Field of the Invention

The invention relates generally to conveyor chains for textile processing machines and more particularly to a conveyor chain having a lubricant supply that is safeguarded at all times in the event of maximum mechanical stressing.

2. Brief Description of the Related Art

It is well known to use conveyor chains to connect tenter clips to one another to form chain belts which rotate in textile processing machines, for example in tentering frames. For reasons of reliability in operation, the antifriction bearings (whose outer rings roll on guide bars to absorb the tensile stresses resulting from the tension of the textile breadth) are regularly serviced with a supply of lubricant.

A conveyor chain of the type generally discussed above is described in German Utility Patent No. 17 07 286. This type of conveyor chain is disadvantageous because the link bushing is not secured against rotation, and as a result, the connection between the transverse bore in the pin (on one side) and the roller element (on the other side) can be closed by the link bushing. A further disadvantage is that the roller element rolls directly on the link bushing. Although lubrication of the antifriction bearing can take place in this way for a very short time (provided that the link bushing has not rotated), the link bushing must be made of a special bearing material having increased hardness which results in considerable costs. If not, increased wear will occur which reduces the productivity of the textile processing machines.

An object of the invention is to provide a conveyor chain of the aforementioned kind which is distinguished by a long service life, safeguarding at all times the possibility of relubrication of the antifriction bearing. This object is attained by provisions as simple as possible, in particular by the use of a maximum number of standardized components.

SUMMARY OF THE INVENTION

According to the invention, a complete antifriction bearing, including the internal ring, is provided, which guarantees a low degree of wear and low frictional losses. A conveyor chain, fabricated in accordance with the teachings of the invention, is particularly well suited for use in high-speed textile processing machines with elevated temperature differences since, in the presence of the aforementioned stresses, the conveyor chains are especially delicate if the lubrication system fails, while, at the same time, the individual mechanical components show a pronounced tendency to rotate relative to one another.

A preferred embodiment of the invention is distinguished in that between the cover disc and the antifriction bearing, a spacer ring is interposed which presents at least one passage. A reliable lubricant connection is obtained in this way with particularly simple means. The spacer ring is preferably coupled to the side bar in a positive locking fit in a manner which prevents rotation of the spacer ring. The passage is formed in a particularly simple manner by an open region of a C-shaped ring element which is secured against rotation by the projecting of a bead being positioned in the cover disc. Prevention of rotation of the spacer ring is ensured in that the side of each side bar facing the spacer ring is formed with one projection in the region of the passage of a pin which is engageable with a matching recess at the spacer ring. In this manner, the cover disc also prevents rotation of the spacer ring by a punching operation.

An improvement of the conveyor chain of the aforementioned kind can be attained in that a foil bearing is positioned between the pin and link bushing. The foil bearing defines recesses distributed over its circumference at least in the region which is axially level with the transverse bore in the link bushing. Due to this provision, a connecting duct between the transverse bore in the link bushing and the lubricant ducts in the pin is safeguarded even if the foil bearing makes a rotating movement about its longitudinal axis. It is advantageous to provide means for fixing the foil bearing in an axial position in order to ensure the aforementioned connection even in the event of maximum mechanical stresses.

Further advantageous features and the structure of the conveyor chain of the present invention will be disclosed by the following description made with reference to the accompanying drawing.

DETAILED DESCRIPTION

Figure 1:
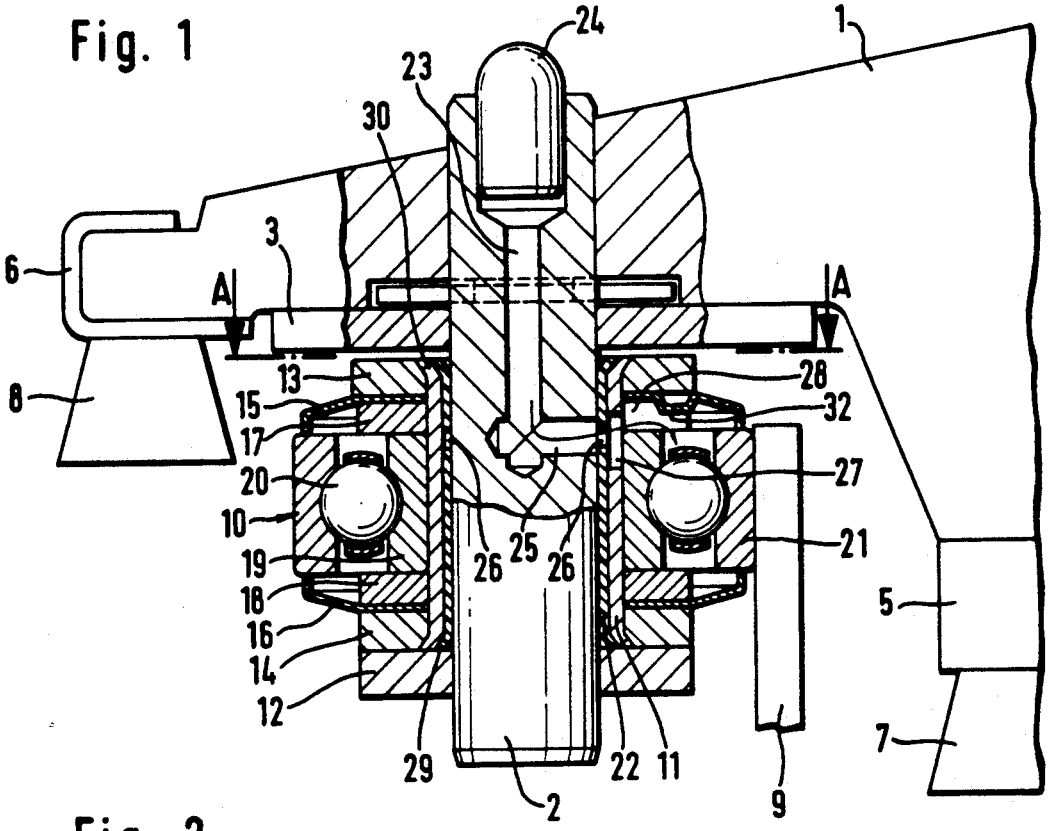
FIG. 1 shows a longitudinal section through a conveyor chain mounted on the tenter clip.

FIG. 1 shows a tenter clip body 1 which is screwed to an upper plate 3 by means of a screw which is not illustrated in the drawing. A pin 2 (the tenter clip has a setup which is symmetrical with the transverse center line) is guided both by a bore in the upper plate and by a bore in the tenter clip body 1. The pin 2 is secured against rotation by a locking plate which is accommodated in a milled recess provided in the surface of the tenter clip body facing the upper plate and which engages a tangential groove of the pin 2. On the right hand side of the tenter clip body 1 when viewing the drawing, there is a small flap not shown in the drawing in a cut-away region which tensions the textile breadths. A sliding plate 5 which slides on a slide rail 7 is fixed to the tenter clip body on that side. On the opposite side, a sliding plate 6 is positioned which is supported on a slide rail 8. The transverse forces originating from the tension of the textile breadth and acting on the tenter clip are absorbed by a guide bar 9 by which the tenter clip body is supported through the pin 2, a link bushing 11 and a ball bearing 10. The bearing is designed to form part of the conveyor chain, being positioned between the upper plate 3 and the lower plate 12. The upper plate 3 and a lower plate 12 are interconnected and, thus, are also connected to the tenter clip body 1 through a bracket shaped section which is not shown in the drawing. The chain link is comprised of an upper and a lower side bar 13, respectively 14, of an upper and a lower cover disc 15, respectively 16, of an upper spacer ring 17, of a lower spacer ring 18, of an internal ring 19 of an antifriction bearing positioned between the former two components, of a roller element 20 which is guided by a cage, and of an outer ring 21. These latter components are mounted on the link bushing 11 and are kept together in an axial direction by a riveting operation, namely, by a radial flaring of the end regions of the link bushing 11.

A foil bearing 22 is positioned between the link bushing 11 and the pin 2. A lubricant duct is defined in the pin 2 from a longitudinal bore 23 intersecting a transverse bore 25, and closed on top by a lubricating nipple 24. The lubricant connection leads from the transverse bore 25 in the pin 2 through punched out recesses 26 in the foil bearing 22 to a transverse bore 27 in the link bushing 11 and from the latter through a passage 28 in the upper spacer ring 17 to the ball bearing 10.

Figure 2:
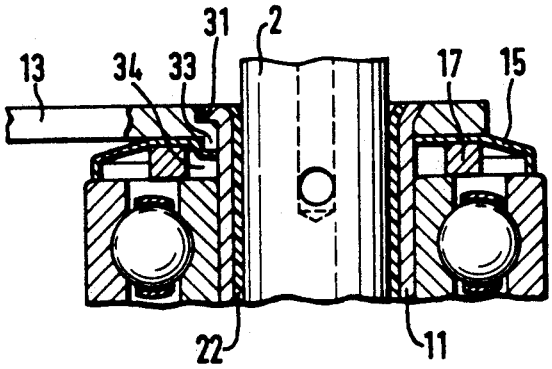
FIG. 2 shows a part-section through another axial plane.
Figure 6:
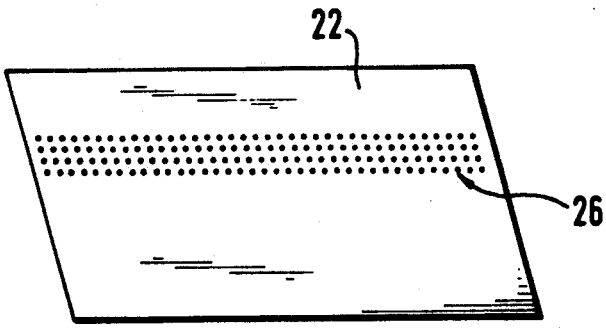
FIGS. 6 to 8 each show an illustration of the foil bearing.
Figure 7:
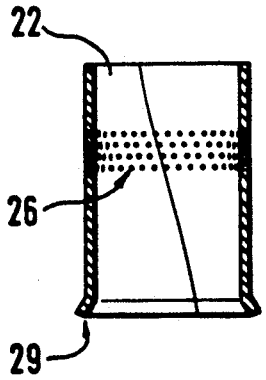
Figure 8:
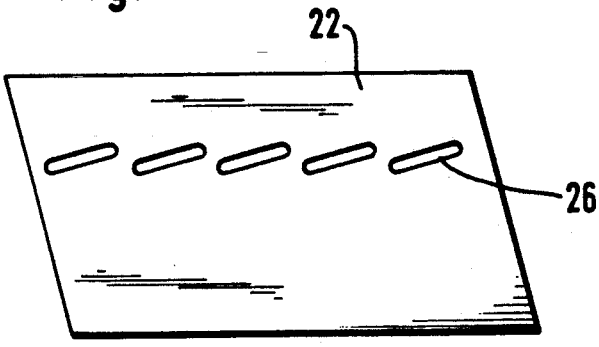

In order to ensure that the lubricant duct will not be closed up even in the event of elevated circulating speeds of the chain which go along with strong vibrations and with rapid reversing motions, the foil bearing 22 is furnished throughout with punched out openings, perforations, oblique slots, etc. axially at the level of the transverse bores 25 and 27 as is illustrated by FIGS. 6 to 8. Rotation of the foil bearing relative to the pin 2 or the link bushing 11, as may occur at the moment of reversing of the chain, can be accepted. The foil bearing 22 is manufactured from a PTFE ribbon cut to lozenge shape and is rolled together before its insertion in the link bushing 11 so as to form a sleeve. Subsequently, a first radial flaring 29 is made. The foil bearing is then introduced into the preassembled chain link and is fixed in a predetermined position in the axial direction by a second radial flaring 30. In order to prevent any rotation of the link bushing 11 in the side bar 13, the latter is formed with a recess 31 (see FIGS. 2, 3 and 4). During riveting of the chain link, a positive locking fit is thereby achieved between the side bar 13 and link bushing 11. During the travel of the conveyor chain in a straight direction, the transverse bore 25 and the transverse bore 27 are always perfectly aligned with each other.

The spacer ring 17 is secured against rotation relative to the link bushing 11 by the provisions described below in order to ensure that the passage 28 in the upper spacer ring 17 also is always in fluid communication with the transverse bore 27.

Figure 3:
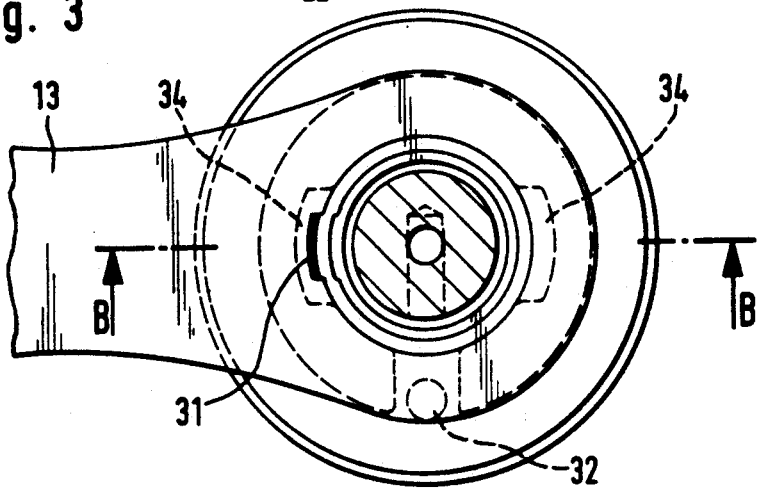
FIG. 3 shows a cross section along the line A—A in FIG. 1.
Figure 4:
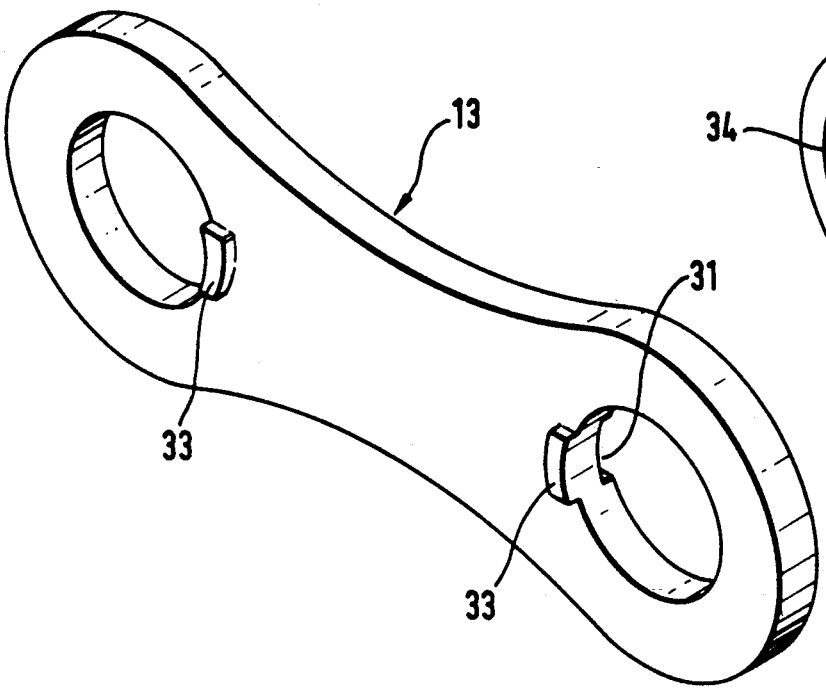
FIGS. 4 and 5 each show a perspective representation of the side bar, respectively of the spacer ring.
Figure 5:
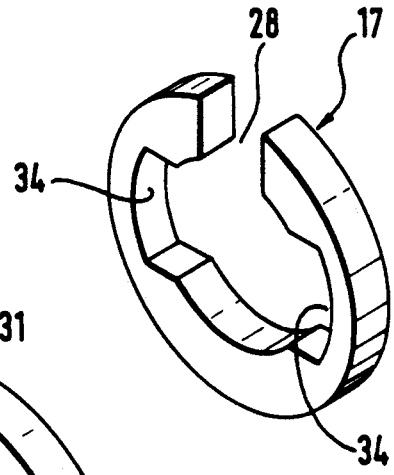

According to FIGS. 1 and 3, the upper cover disc 15 is provided with a circular bead 32 which projects into the passage 28 of the upper spacer ring 17. In the relieved zone of the upper side bar 13, projections 33 are positioned in the region of the through bore for accommodating the pin whose axis of extension runs parallel to the longitudinal axis of the pin. The projections 33 are associated with clearances 34 defined adjacent to the upper spacer element 17 (FIGS. 2 to 5). In the event of axial compression and riveting of the chain link, the projections 33 will penetrate into the clearances 34 and will simultaneously caulk the upper cover disc 15 in that region. In this manner, it will be assured that all ducts forming the lubricant connection remain in communication with each other when the conveyor chain travels in straight direction, even in the event that maximum mechanical stress is applied to the chain.

What is claimed is:

1. In a conveyor chain for textile processing machines including a tenter clip body and a pin for connecting said conveyor chain to said tenter clip body, a link bushing surrounding said pin, an antifriction bearing surrounding said link bearing, said link bushing defining a transverse bore and said pin defining a lubricant duct for applying lubricant to said antifriction bearing, and at least one side bar supported on said link bushing, the improvement comprising:

means for coupling said link bushing (11) to said side bar (13) for preventing rotation of said link bushing, said antifriction bearing (10) including a roller element (20), an internal ring (19) provided between said roller element (20) of the antifriction bearing (10) and the link bushing (11), said internal ring being axially staggered relative to said transverse bore (27), and at least one cover disc (15) mounted over one end of said antifriction bearing (10) in an axial direction.

2. A conveyor chain as set forth in claim 1 further including a foil bearing (22) arranged between said pin (2) and said link bushing (11), said foil bearing having recesses (26) distributed over the surface thereof at least in the region of said foil bearing positioned axially at the level of said transverse bore (27) defined in said link bushing.

3. A conveyor chain as set forth in claim 2 wherein said foil bearing (22) is fixed in an axial direction.

4. A conveyor chain as set forth in claim 1, further including a spacer ring (17) positioned between said cover disc (15) and said antifriction bearing (10), said spacer ring (17) defining at least one passage (28).

5. A conveyor chain as set forth in claim 4, wherein said spacer ring (17) is connected with the said side bar (13) in a positive locking fit.

6. A conveyor chain as set forth in claim 4 wherein said passage (28) is formed by the open region of a C-shaped ring element, and said cover disc (15) defines a bead (32) oriented to project into said open region.

7. A conveyor chain as set forth in claim 5 wherein said passage (28) is formed by the open region of a C-shaped ring element, and said cover disc (15) defines a bead (32) oriented to project into said open region.

8. A conveyor chain as set forth in claim 4 including a projection (33) defined on a side of said side bar (13) facing said spacer ring (17) in the region of passage of said pin, said spacer ring defining a clearance (34), and said projection (33) being engageable in said clearance (34) defined by said spacer ring (17).

9. A conveyor chain as set forth in claim 5 including a projection (33) defined on a side of said side bar (13) facing said spacer ring (17) in the region of passage of said pin, said spacer ring defining a clearance (34), and said projection (33) being engageable in said clearance (34) defined by said spacer ring (17).

10. A conveyor chain as set forth in claim 6 including a projection (33) defined on a side of said side bar (13) facing said spacer ring (17) in the region of passage of said pin, said spacer ring defining a clearance (34), and said projection (33) being engageable in said clearance (34) defined by said spacer ring (17).

11. A conveyor chain as set forth in claim 7 including a projection (33) defining on a side of said side bar (13) facing said spacer ring (17) in the region of the passage of said pin, said spacer ring defining a clearance (34), and said projection (33) being engageable in said clearance (34) defined by said spacer ring (17).

12. A conveyor chain as set forth in claim 8, wherein said cover disc (15) is oriented relative to said projection (33) and said clearance (34) such that a portion of said cover disc (15) is received in said clearance (34) of said spacer ring (17) when said projection (33) engages said clearance (34).

13. In a conveyor chain for textile processing machines including a tenter clip body and a pin for connecting said conveyor chain to said tenter clip body, a link bushing surrounding said pin, an anti fiction bearing surrounding said link bearing, said link bushing defining a first transverse bore and said pin defining a lubricant duct including a second transverse bore for applying lubricant to said antifriction bearing, and at least one side bar supported on said link bearing, the improvement comprising:

a foil bearing 22 arranged between said pin (2) and said link bushing (11), said foil bearing having recesses (26, 27) distributed over the circumference thereof at least in the region of said foil bearing positioned axially at the level of said transverse bores (25, 27) defined in said pin and said link bushing.

14. A conveyor chain as set forth in claim 13, wherein said foil bearing (22) is fixed in an axial direction.

* * * * *